US005219320A

United States Patent [19]

Abrams et al.

[11] Patent Number: 5,219,320

[45] Date of Patent: Jun. 15, 1993

[54] METHOD OF AND APPARATUS FOR ATTACHING A SPOUT TO A PLANAR PORTION OF A CONTAINER

[75] Inventors: Robert S. Abrams, Albany, N.Y.; Joseph H. Miller, Farmington, Conn.; John F. Nash, Jr., Schenectady, N.Y.

[73] Assignee: Capitol Spouts, Inc., Fultonville, N.Y.

[21] Appl. No.: 657,994

[22] Filed: Feb. 20, 1991

[51] Int. Cl.[5] ..... B31B 1/84; B31B 1/90

[52] U.S. Cl. ..... 493/8; 493/87

[58] Field of Search ..... 493/8, 29, 87, 102, 493/213, 929

[56] References Cited

U.S. PATENT DOCUMENTS

| | | | |
|---|---|---|---|
| 1,538,612 | 5/1925 | Betner . | |
| 1,989,039 | 1/1935 | Geyer | 226/92 |
| 2,360,435 | 10/1941 | Martin | 493/417 |
| 3,144,816 | 8/1964 | Walker et al. | 93/36.01 |
| 3,307,714 | 3/1967 | Maciejczak | 214/1 |
| 4,055,032 | 10/1977 | Hammond | 53/14 |
| 4,246,062 | 1/1981 | Christine | 156/498 |
| 4,507,168 | 3/1985 | Konaka | 156/379.8 |
| 4,566,250 | 1/1986 | Matsumura et al. | 53/128 |
| 4,604,850 | 8/1986 | Reil | 53/423 |
| 4,660,353 | 4/1987 | Greenwell | 53/449 |
| 4,661,091 | 4/1987 | Moen | 493/417 |
| 4,712,665 | 12/1987 | McDonald et al. | 198/346.2 |
| 4,788,811 | 12/1988 | Kawajiri et al. | 53/426 |
| 4,813,578 | 3/1989 | Gordon et al. | 222/541 |
| 4,866,907 | 9/1989 | Iuchi et al. | 53/299 |
| 4,909,434 | 3/1990 | Jones et al. | 229/125.15 |

FOREIGN PATENT DOCUMENTS 1284775 8/1985 U.S.S.R. .

*Primary Examiner*—William E. Terrell

*Attorney, Agent, or Firm*—Burns, Doane, Swecker & Mathis

[57] ABSTRACT

A method and apparatus for attaching a spout to a planar portion of a container, such as a milk or juice container, which may be incorporated in a conventional conveyor line. The method includes the steps of successively positioning the container at three stations, first, where a hole is punched, second, where a bonding agent is applied, and third, where the spout is installed on the container. An apparatus for carrying out the method includes mechanisms for positioning the container at each station relative to an edge of the container so that the operation can be performed on the container.

33 Claims, 10 Drawing Sheets

METHOD OF AND APPARATUS FOR ATTACHING A SPOUT TO A PLANAR PORTION OF A CONTAINER

FIELD OF THE INVENTION

The present invention relates to methods of and apparatus for attaching objects such as spouts to objects such as planar portions of articles. More particularly, the present invention relates to methods of and apparatuses for attaching spouts to gable tops of paperboard cartons.

BACKGROUND AND SUMMARY OF THE PRESENT INVENTION

Various apparatus which form and fill gable top paperboard cartons are known in the prior art. For example, the Cherry-Burrell packaging machine, Model H-75, is a standard in the field. The Cherry-Burrell machine forms a paperboard carton having four sides and a bottom, partially folds the upper ends of the sides of the carton into a gable top, fills the carton, and completely folds and seals the gable top. The Cherry-Burrell machine operates continuously in an assembly line-type manner, such that cartons are formed and filled one by one in the machine at stations which each perform a small task on the carton in under one second, before the carton moves on to the next station.

Gable top cartons of this type, though, have disadvantages when they are used to store and dispense liquid products such as milk, juice, etc. Specifically, the gable top can often be difficult to open correctly without accidentally tearing the carton, and, when the top is reclosed, it fails to provide a liquid-tight closure and thus allows spillage of the liquid if the carton is accidentally tipped over or shaken.

Accordingly, it has become desirable to place a releasable closure on a sloping side of the gable top in place of opening the gable top, wherein the closure is more easily opened and is liquid-tight when reclosed. For example, U.S. Pat. No. 4,669,640 to Ando et al. discloses a method of attaching a mouthpiece 34 to a gable top carton 20, wherein the mouthpiece is pushed through an aperture 32 in a sloping side 28 of the gable top carton 20 such that the mouthpiece 34 is held to the side 28 by a flange 46 and retainer lugs 48 of the mouthpiece 34, and wherein the flange 46 is then thermally or ultrasonically fused to the side 28.

U.S. Pat. No. 4,813,578 to Gordon et al. also discloses a method of attaching a pour spout 40 to a gable top carton 10, wherein the spout 40 is first placed on the open gable top such that a flange 46 overlies an opening 30 in the gable top, and wherein the flange 46 is then heated and pressed into contact with the gable top such that the flange 46 adheres to the gable top.

Further, U.S. Pat. No. 4,909,434 to Jones et al. discloses a method of securing a pouring spout 1 to a sloping side 2 of a gable top carton, wherein a hole is first cut in the sloping side 2, wherein the spout 1 is then insetted into the hole such that a flange 6 thereof extends around the hole, wherein a skirt section 4 of the spout 1 is then heated to bend and form a second flange around an opposite side of the hole, and wherein both of the flanges are heated to bond and seal with the material of the side 2.

The above methods of attaching spouts to gable top containers have the disadvantage, among others, that they employ thermal or ultrasonic devices to fasten a spout to a container. Such methods are accordingly relatively energy intensive and thus expensive, and, due to the time often required for thermal or ultrasonic fastening, may be difficult to integrate into the operation of a packaging machine such as the Cherry-Burrell machine.

In view of the above, it is an object of the present invention to provide a method and apparatus for attaching spouts to planar portions of articles such as containers.

It is a further object of the present invention to provide a method and an apparatus for attaching spouts to planar portions of articles, wherein the method and apparatus are relatively non-energy intensive.

It is also an object of the present invention to provide a method and apparatus for attaching spouts to planar portions of articles, which are readily integratable into a standard forming and fitting machine, such as a Cherry-Burrell forming and filling machine.

Another object of the present invention is to provide a method and apparatus for preforming the steps of attaching spouts to planar portions of articles with highly accurate repeated horizontal and vertical positioning of the articles at each step.

A further object of the present invention is to provide a method and apparatus for attaching spouts to planar portions of articles with relatively few break downs and relatively little need for repairs.

The above objects as well as other objects not specifically enumerated are accomplished by a method of attaching a spout to a planar portion of an article in accordance with the present invention. In one aspect of the present invention, the method includes the steps of moving the article successively to at least three stations of a conveyor line, positioning an edge portion of the planar portion at a first predetermined position relative to a hole punch at a first station, punching a hole through the planar portion at the first station, positioning the edge portion at a second predetermined position relative to a bonding site preparer at a second station, preparing a bonding site on the planar portion around the hole at the second station, positioning the edge portion at a third predetermined position relative to a spout applicator at a third station, and attaching a spout to the planar portion about the hole at the third station.

The objects of the invention are also accomplished by an apparatus for attaching a spout to a planar portion of an article. The apparatus includes a hole punch, a first positioning means having a first positioning surface thereon located in a first predetermined position relative to the hole punch for positioning the article relative to the hole punch, a bonding site preparer, a second positioning means having a second positioning surface thereon located in a second predetermined position relative to the bonding site preparer for positioning the article relative to the bonding site preparer, a spout applicator, and a third positioning means having a third positioning surface thereon located in a third predetermined position relative to the spout applicator for positioning the article relative to the spout applicator.

In another aspect of the present invention, the apparatus includes punching means for punching a hole, wherein the punching means punches along a central punching axis. A first positioning means for positioning an edge portion of the planar portion is provided which first positioning means is spaced from the punching axis by a predetermined distance. A bonding agent applying means for applying bonding agent in a circle about a central applying axis, is associated with a second positioning means for positioning the edge portion of the planar portion, wherein the second positioning means is spaced from the central applying axis by the predetermined distance. Further, spout attaching means for attaching a spout is provided such that the spout attaching means has a central attaching axis, and third positioning means for positioning the edge portion of the planar portion is provided, wherein the third positioning means is spaced from the attaching axis by the predetermined distance.

The present invention also relates to an apparatus for attaching a spout to a gable top of a paperboard carton, which includes a hole punch mounted for translation along a punching axis, a first positioning means including a substantially horizontal first positioning surface spaced from the punching axis by a predetermined distance, a glue applicator mounted for rotation about a central gluing axis, a second positioning means including a substantially horizontal second positioning surface spaced from the gluing axis by the predetermined distance, a spout applicator mounted for translation along a spout applying axis, a third positioning means including a substantially horizontal third positioning surface spaced from the spout applying axis by the predetermined axis. This aspect of the present invention also includes three suction cups connected to a source of suction and spring-mounted bar beneath the first, second, and third positioning means respectively. Preferably, the three suction cups are mounted on a single elongated lifting bar extending beneath the first, second, and third positioning means in order to further ensure repeatability of the lifting step.

The present invention also relates to a method of positioning a planar portion of an article, which includes the steps of moving the article relative to a positioning means via moving means. The planar portion of the article is guided between a pair of restraining surfaces of the positioning means, while an edge portion of the planar portion is positioned against a positioning surface of the positioning means. Further, the moving means has an overstroke which is compensated to ensure that the edge of the article is stopped once the edge portion is properly positioned against the positioning surface.

The objects of the present invention are also accomplished by an apparatus for positioning a planar portion of an article, including a positioning means which includes a guide surface, a pair of spaced restraining surfaces, and a positioning surface. A means for moving the article relative to the positioning means is provided and guides an edge portion of the planar portion along the guide surface into a location between the restraining surfaces and positions the edge portion of the planar portion against the positioning surface. Compensating means for compensating for an overstroke of the moving means and for stopping movement of the article once the edge portion of the planar portion is properly positioned against the positioning surface is also provided.

BRIEF DESCRIPTION OF THE DRAWINGS FIGURES

The preferred embodiments of the present invention will be described in greater detail with reference to the accompanying drawings, wherein like members bear like reference numerals and wherein.

DETAILED DESCRIPTION OF THE PREFERRED EMBODIMENT

With reference to FIGS. 1–11, a method of and apparatus for attaching a spout to a planar portion of an article such as a gable top of a paperboard carton will be described hereinbelow. A suitable spout for use in the method and apparatus of the present invention is disclosed in copending application Ser. No. 07/646,439, filed on Dec. 27, 1990, which is entitled "Releasable Attachment for Containers".

Figure 1:
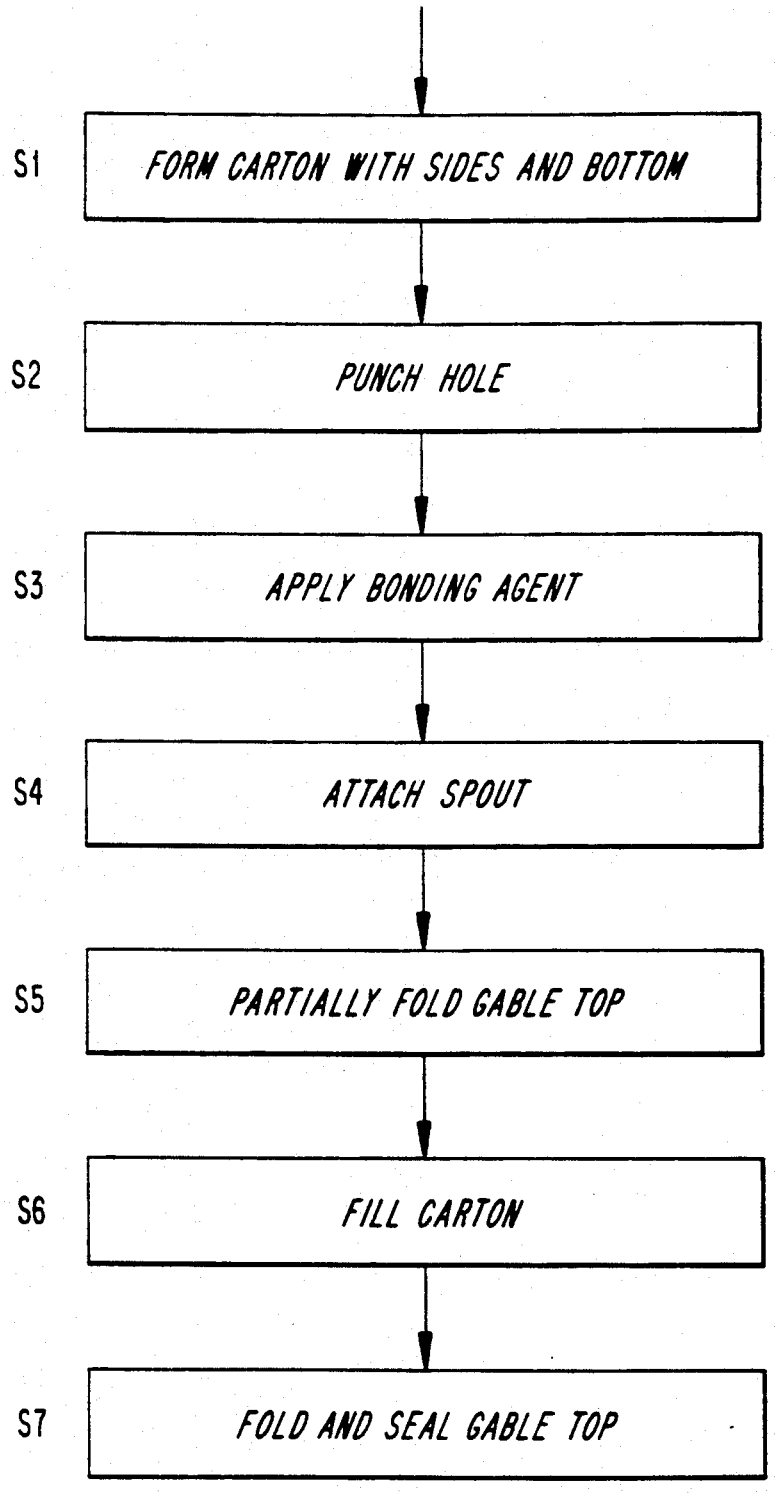
FIG. 1 is a flow diagram broadly showing the sequence of steps of a carton forming and filling method which includes the method of the present invention.

As is shown in FIG. 1, the method and apparatus of the present invention can be integrated into an overall carton forming and filling process being performed by a carton forming and filling apparatus, such as the aforementioned Cherry-Burrell machine. In the forming and filling apparatus, a carton is formed with sides and a bottom in step S1. At this stage the portions of the carton that ultimately form the gable top are merely straight extensions of the sides. The carton is then acted upon by the apparatus of the present invention in steps S2, S3, and S4. In step S2, a hole is first punched into a side of the carton which will eventually become a sloping side of the gable top of the carton. Then, in step S3, a bonding agent is applied to the carton side around the hole, and, in step S4, a spout is inserted into and placed about the hole such that the bonding agent applied in step S3 bonds the spout to the carton side.

The carton is then acted upon again by the forming and filling apparatus in step S5, wherein the carton is partially folded to form a gable top, and thereafter in step S6 wherein the carton is filled with a liquid such as juice or milk. In step S7, the gable top of the carton is folded and sealed to form the finished container. Thus, the apparatus and method of the present invention can be integrated directly into the operation of the forming and filling apparatus, allowing the forming and filling apparatus to operate at the same speed it would otherwise. If desired, of course, steps S2–S4 of the present invention could be performed after step S5, by simply integrating the apparatus into the forming and filling apparatus at a location upstream of the partial folding station of the forming and filling apparatus, as is shown in FIG. 2.

It should be realized that integrating a spout attaching apparatus which involves the performance of three separate steps on each carton to which a spout is attached into a high-speed packaging machine can be extremely difficult. Specifically, no two of the operations involved in attachment can be performed on the same carton in the limited time that a single carton is left at a single location or station by the packaging machine. Accordingly, it becomes necessary to perform only one operation at each one of three stations, which thereby requires very precise positioning and repositioning of the cartons at each of the three stations. Such precise positioning and repositioning is rendered especially difficult when only a very short time may be taken for positioning and repositioning, and when the articles being positioned and repositioned are such relatively imprecisely-formed and easily bendable articles as paperboard cartons. It should therefore be kept in mind that an important object of the present invention is the precise high-speed positioning and repositioning of paperboard cartons at three separate work stations.

Figure 2:
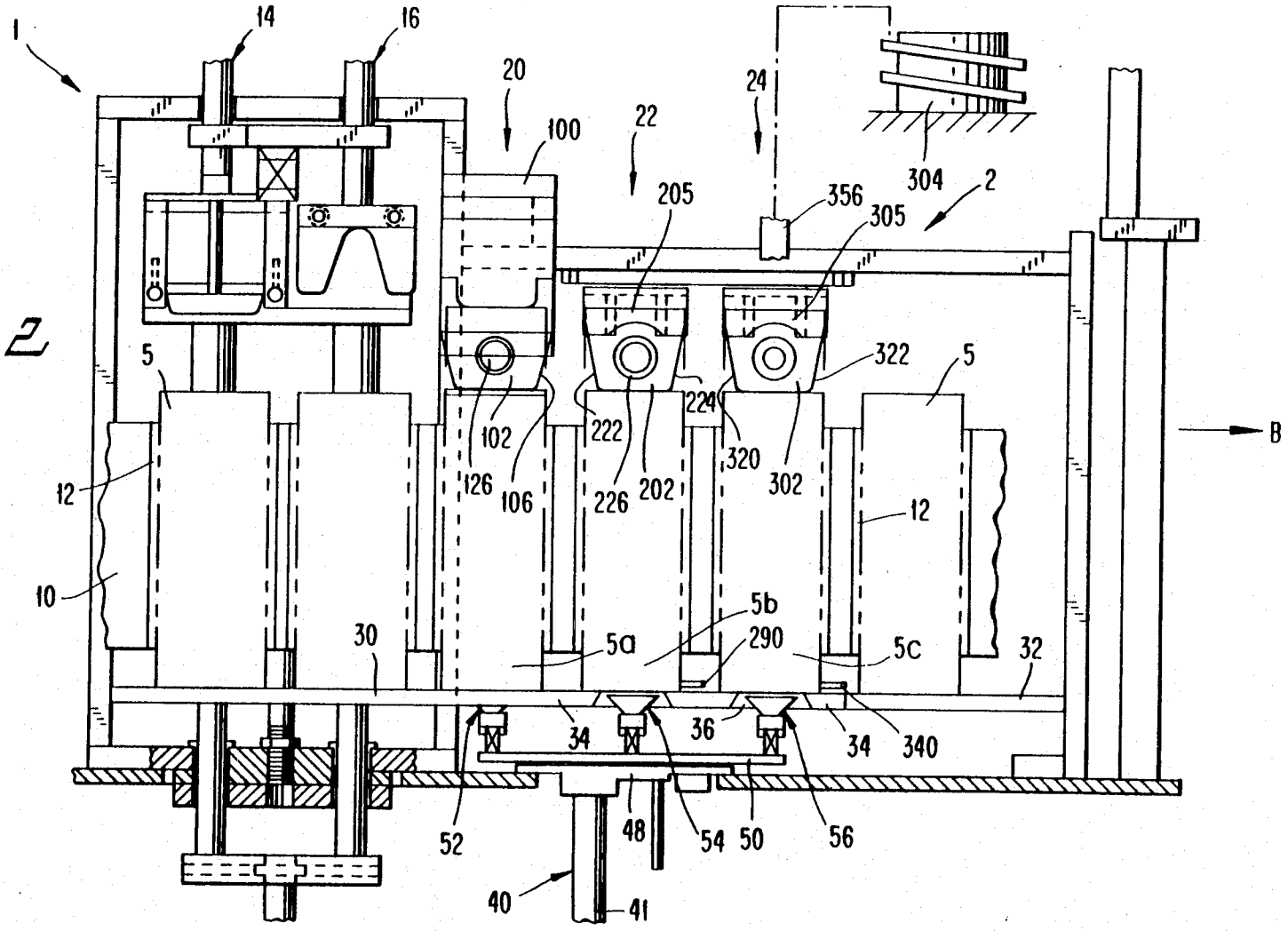
FIG. 2 is a partial cross-sectional front view of a portion of the apparatus of the present invention.

FIG. 2 is a front view of portions of a carton forming and filling apparatus 1 and the apparatus 2 of the present invention. In the apparatuses 1, 2, a series of empty cartons 5 each having four sides and a bottom are moved along in the direction of arrow B by a conveyor 10, which includes a plurality of extensions 12 which also extend in a plane perpendicular to the plane illustrated in FIG. 2 to support and move the cartons 5. The conveyor 10 is driven by a driving means (not shown) which is indexed such that the cartons are moved a discrete distance forward by the conveyor 10, are then stopped for a discrete amount of time, are again moved the same discrete distance forward by the conveyor 10, etc., as will be discussed further hereinbelow. The conveyor 10 thus moves each carton 5 successively to an operation station, leaves it there for a present period of time, and then moves it to a next operation station.

The apparatus 1 further includes two rails 30, 32 associated with the apparatus 1 over which the cartons 5 slide as they are moved by the conveyor 10. Also, two rails 34, 36 which extend between the plates 30, 32 are provided below the conveyor 10, associated with the apparatus 2, and the cartons 5 also slide over the rails 34, 36 as they are moved by the conveyor 10. The rails 30, 32 and the rails 34, 36 support the cartons 5 as they are moved along. For clarity, the rail 34 is shown in partial breakaway.

In FIG. 2, portions of five separate operation stations are shown. First, two partial folding stations, 14, 16 which are part of a standard carton forming and filling apparatus partially fold a gable top into each of the cartons 5 that passes through the stations 14, 16. The stations 14, 16 thus perform step S5 of the flow diagram of FIG. 1. Directly downstream of the stations 14 and 16 are three stations 20, 22, and 24 at which the method of the present invention is performed. Downstream of the stations 20, 22, and 24 are stations (not shown) which perform the filling step S6 and the forming and sealing step S7. While the partial folding operation stations are shown in FIG. 2 upstream of the apparatus 2 of the present invention, the various stations of the present invention are advantageously arranged upstream of the partial folding station as was diagrammed in FIG. 1, since the sides of cartons are straighter and easier to position prior to partial folding.

The station 20 of FIG. 2 is the station where the hole punching step S2 of FIG. 1 is performed. At the station 20, a hole punch 100 is located with a first positioning block 102 above a carton 5, as will be described in more detail hereinbelow with reference to FIG. 5. The station 22 of FIG. 2 performs the bonding agent applying step S3 of FIG. 1, and includes a second positioning block 202 which is part of a bonding agent applying apparatus 200 (FIGS. 6 and 7), all of which is not shown in FIG. 2 for clarity, but which is located in front of the positioning block 202 in FIG. 2. The second positioning block 202 is located above a carton 5 at the station 22, as will be described hereinbelow.

The station 24 of FIG. 2 includes a third positioning block 302 and a vibratory spout feeder 304, which are part of a spout attaching apparatus 300 (FIGS. 8 and 9), all of which is not shown in FIG. 2 for clarity, but which is located in front of the positioning block 302 in FIG. 2. The vibratory spout feeder 304 is not drawn to scale, and is located at a location remote from FIG. 2. The spout attaching step S4 of FIG. 1 is performed at the station 24. As shown in FIG. 2, the third positioning block 302 is located above a carton 5 at the station 24, as will be described hereinbelow.

With regard to the use of the term "positioning block" throughout this application, it is to be understood that although the term "block" is used herein to refer to several pieces fixed together, such collections of pieces may be each formed as a single one-piece block and remain within the definition of the term "block" as used herein.

The Lifting Device

Figure 4:
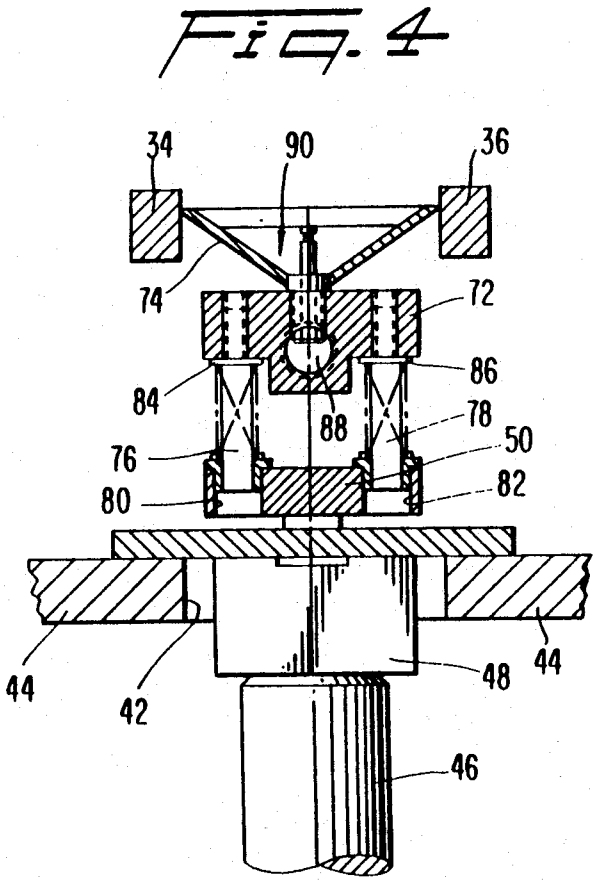
FIG. 4 is a cross-sectional view through line A-A of FIG. 3.
Figure 3:
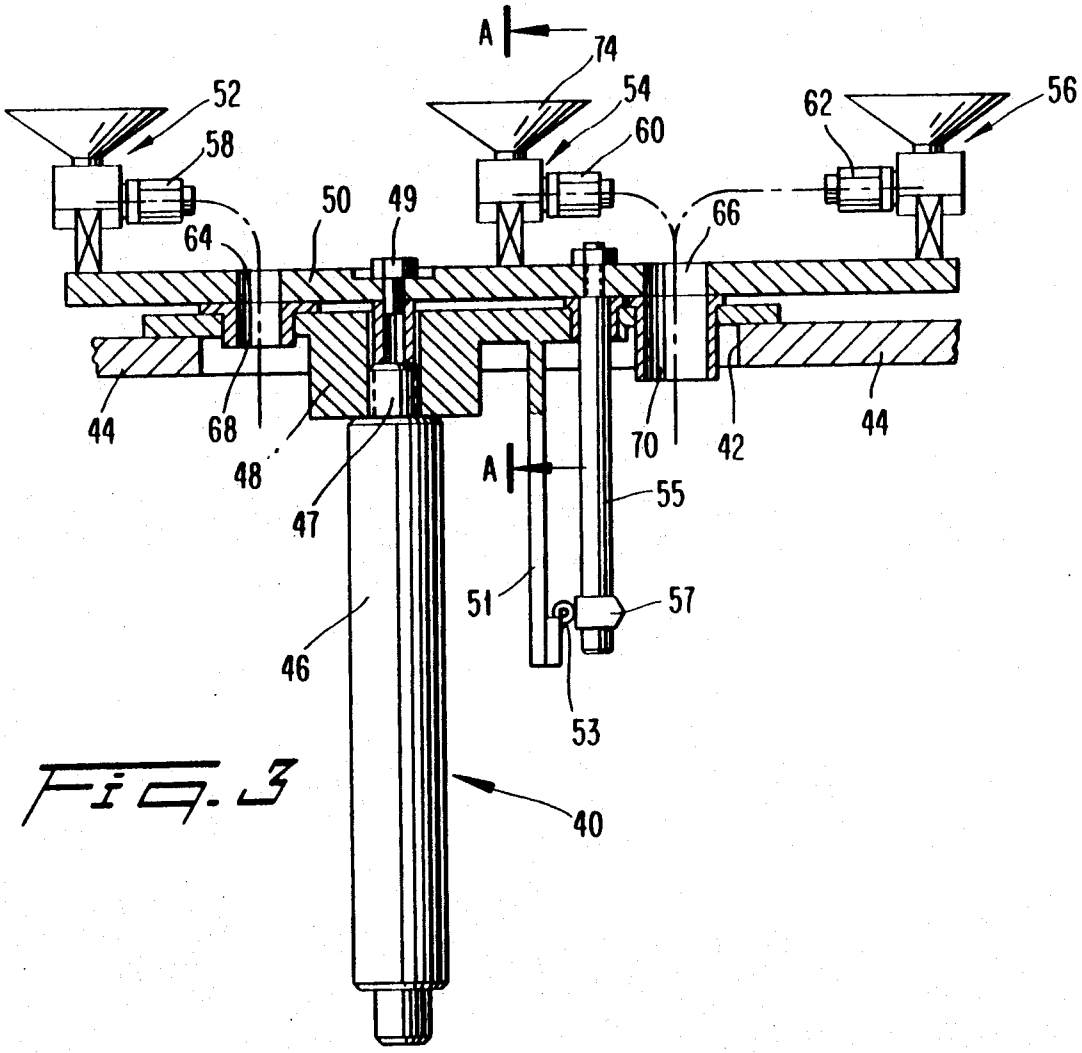
FIG. 3 is a partial cross-sectional front view of a lifting device of the present invention.

Below the cartons 5 at the stations 20, 22, and 24, a lifting device 40 is located. As seen in FIGS. 3 and 4, the lifting device 40 extends upwardly through a hole 42 in a plate 44 of the apparatuses 1, 2, and includes a cylinder 46 which is threadedly attached to a block 48 which is fastened to an upper surface of the plate 44. A piston 47 is slidably mounted in the cylinder 46, extends slidably through the block 48, and is threadedly attached by a bolt 49 to an elongated lifting bar 50 which extends into all three stations 20, 22, and 24.

Three suction cup assemblies 52, 54, and 56 are spring mounted to the lifting bar 50 such that they are each located in the lower end of a station 20, 22, 24. Each of the assemblies 52, 54, 56 is connected to a source of suction/pressure (not shown) by a coupling 58, 60, or 62, one of the number of hoses (not shown) which run through holes 64, 66 in the lifting bar 50 and holes 68, 70 in the block 48, and a T-valve (not shown). An elongated arm 51 extends downwardly in FIG. 3 from the block 48, and it carries a limit switch 53 at a lower end thereof. Also, a rod 55 is fixed to the lifting bar 50 and extends downwardly therefrom in FIG. 3. The rod 55 extends slidably through the block 48, and a ring 57 is mounted around a lower end thereof such that the ring 57 contacts the switch 53 when the lifting device 40 is in its lowered position shown in FIG. 3.

The suction cup assembly 54 is shown in cross-section in FIG. 4, which is a view through line A—A of FIG. 3, and is representative of the other suction cup assemblies 52, 56. The suction cup assembly 54 includes a suction block 72 to which the coupling 60 is coupled, a suction cup 74 mounted to the top of the suction block 72 as seen in FIG. 4, two pins 76, 78 which are threaded into the suction block 72 and which are slidably mounted within holes 80, 82 in the lifting bar 50, and two springs 84, 86 which extend around the pins 76, 78 between the suction block 72 and the lifting bar 50. A central passageway 88 in the suction block 72 communicates the coupling 60 with the interior 90 of the suction cup 74.

In operation, the lifting device 40 is normally located in the lower position shown in FIGS. 2-4 when the conveyor 10 is in the process of moving cartons 5. However, once the conveyor 10 has stopped movement, a lifting means (not shown) automatically presses the piston 47 upwardly. Thus, the lifting bar 50 and the suction cup assemblies 52, 54, 56 are moved upwardly such that the suction cup assemblies move between the rails 34, 36 to contact bottom surfaces of three cartons 5*a*, 5*b*, and 5*c* located in the stations 20, 22, and 24.

Thereafter, the piston 47 continues to move upwardly and thus lifts the cartons 5*a–c* to the first, second, and third positioning blocks 102, 202, and 302. The lifting means is preferably designed to move the lifting bar 50 and hence the cartons 5*a*–5*b* a distance greater than the distance between the positioning blocks and the top of the cartons, i.e., an overstroke. Since each of the suction cup assemblies 52, 54, and 56 is spring-mounted to the lifting bar 50 the overstroke of the lifting bar 50 is compensated for by compression of the spring-mountings, as will be explained further hereinbelow. After an operation has been performed on each of the cartons 5*a–c* at each of the stations 20, 22, 24, the lifting means (not shown) lowers the piston 47, the lifting bar 50, the suction cup assemblies 52, 54, and 56, and thus the cartons 5*a–c* until the cartons 5*a–c* rest once again on the rails 34, 36 and the lifting device 40 is in the lowered position shown in FIG. 3.

When the suction cup assemblies 52, 54, and 56 lift the cartons 5*a–c*, suction from the source of suction/pressure (not shown) causes the suction cup assemblies 52, 54, 56 to form suction attachments to the cartons 5*a–c*. The suction cup assemblies 52, 54, 56 thus automatically pull the cartons 5*a–c* downwardly with them when they move downwardly. This downward suction pulling is designed to ensure that the cartons 5*a–c* do not become stuck in one of the positioning blocks 102, 202, 302, and ensure that the cartons 5*a–c* are lowered accurately within the extensions 12 of the conveyor 10 as quickly as possible. These suction attachments are broken automatically when the lifting bar 50 has been lowered to the point that the ring 57 contacts the limit switch 53. At that point, the switch 53 switches the T-valve (not shown) so that the source of suction/pressure delivers pressurized air into the suction cups through the couplings 58, 60, 62 to eliminate the suction when the cartons 5*a–c* reach the rails 34, 36. The conveyor 10 then once again moves each of the cartons 5 one station forward. The pressurized air is maintained as long as the ring 57 contacts the switch 53. Once the bar 50 is again raised and the ring 57 no longer contacts the switch 53, the T-valve (not shown) is switched back to provide suction from the source of suction/pressure (not shown) to the suction cup assemblies 52, 54, 56 again.

The Hole Punch

Figure 5:
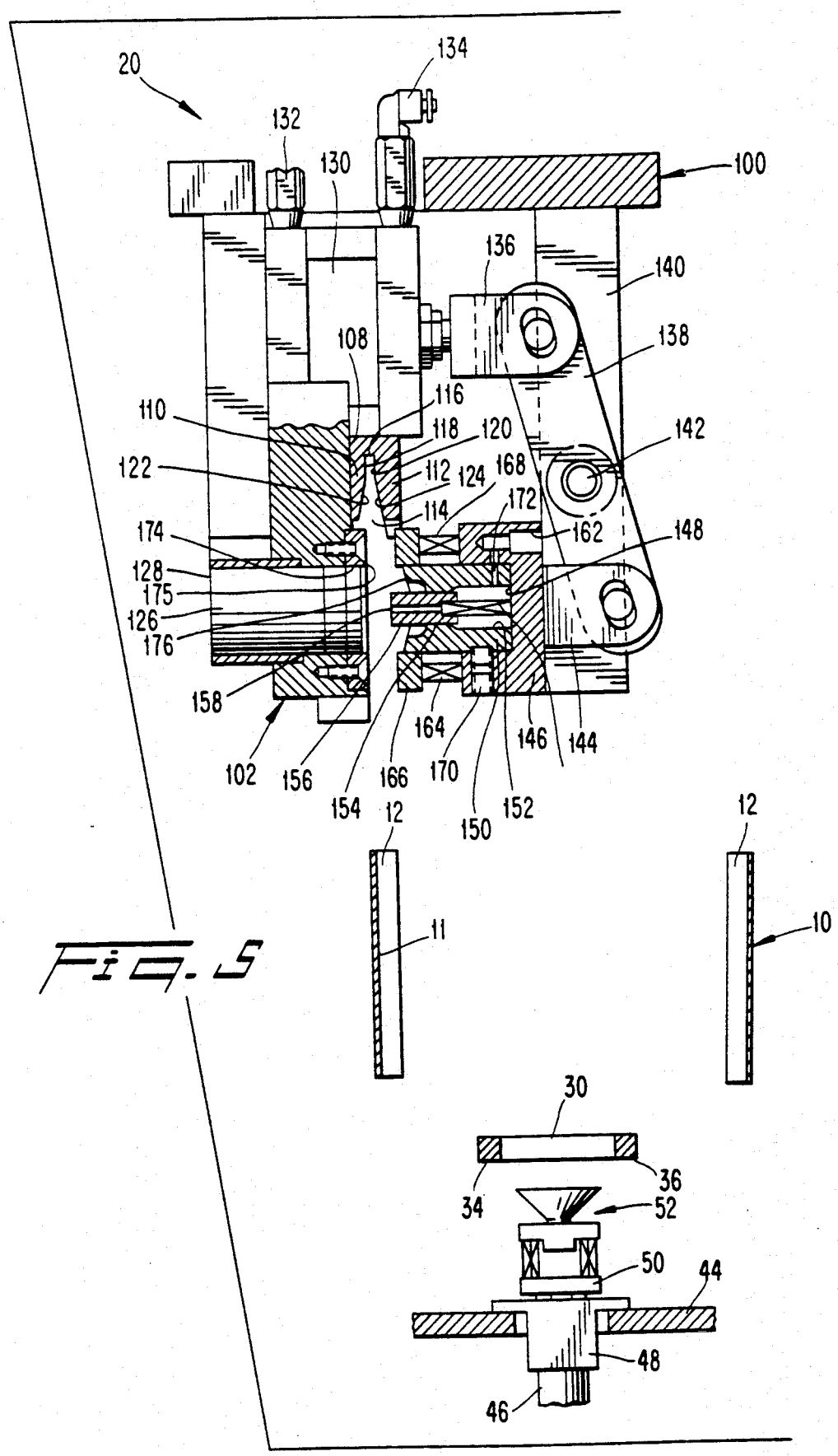
FIG. 5 is a partial cross-sectional side view of a punching apparatus of the present invention.

FIG. 5 is a partial cross-sectional side view of the station 20 of FIG. 2, and is taken from the right side of the station 20 in FIG. 2 looking in a direction opposite to the direction in which the arrow B points. The station 20 includes the hole punch 100, which includes the first positioning block 102. The conveyor 10, the rails 34 and 36, and the suction cup assembly 52 extend into the station 20.

As shown in FIG. 5, the positioning block 102 includes a guiding and positioning piece 108. The piece 108 is generally U-shaped, and includes a pair of extensions 110, 112 which form a central slot 114. The central slot 114 is defined by a substantially horizontal positioning surface 116, a pair of substantially vertical, spaced restraining surfaces 118, 120, and a pair of guide surfaces 122, 124 which are angled from vertical. The distance between the restraining surfaces 118, 120 is essentially equal to the thickness of the wall of the carton. The extension 112 is arch-shaped in a vertical plane parallel to the plane of FIG. 2, so that the extension 112 extends around portions of the hole punch 100 to guide a carton toward a position between the restraining surfaces 118, 120 as early as possible. Also, the positioning block 102 includes a central passageway 126 therethrough which is connected to a suction tube (not shown) at a leftmost end 128 of the passageway 126. A die ring 174 is attached to the positioning block 102 by screws about the passageway 126.

The hole punch 100 also includes a pair of angled positioning sides 104, 106, as shown in FIG. 2, and a piston-and-cylinder arrangement 130 which is connected to a pressure source (not shown) by a pair of couplings 132 134. The piston of the piston-and-cylinder arrangement 130 is connected to a rod 136 which is connected to one end of a lever 138 which is pivotally mounted to a frame 140 of the hole punch 100 by a pin 142. A second rod 144 is attached to an opposite end of the lever 138, and the second rod 144 is rigidly attached to a punch base 146. The punch base 146 is cylindrical, and has a central cylindrical cavity 148 therein which opens toward the positioning block 102.

A cylindrical punch 150 is fixed in the cavity 148, and the cylindrical punch 150 likewise includes a central cylindrical cavity 152 therein which opens away from the positioning block 102. The cylindrical punch 150 also includes a passageway 154 therethrough which extends from an end of the punch 150 which is nearest the positioning block 102 to the cavity 152, and a cylindrical pin 156 which includes a hole 158 therethrough is slidably mounted in the passageway 154 and spring-biased to the left in FIG. 5 by a spring 160.

The punch base 146 additionally includes holes therein in which are slidably mounted pins 164. The pins 164 are threaded into a ring-like stripper plate 166 which is slidably mounted around the cylindrical punch 150, and springs 168 extend around the pins 164 between the stripper plate 166 and the punch base 146 to bias the stripper plate 166 to the left in FIG. 5. The punch base 146 additionally includes a set screw 170 which rigidly connects the punch base 146 to the punch 150, and a pressure passage 162 which is connected to a pressure source (not shown) and which communicates with a pressure passage 172 of the punch 150. The passage 172 in turn communicates with the central cavity 152.

In operation, the suction cup assembly 52 moves upwardly as described above to lift a carton up to the positioning block 102. The restraining surface 110 of the piece 108, a surface 175 of the die ring 174 and an inside surface 11 of the conveyor 10 are all aligned on a single plane, so that as the carton is lifted up to the positioning block 102, an upper edge portion of the side of the carton rises up into the central slot 114. If the carton is for some reason slightly misaligned, the upper edge portion of the carton will contact one of the guide surfaces 122, 124 so that the edge portion is guided between the restraining surfaces 118, 120.

The carton thus moves upwardly until the edge portion of the carton is positioned vertically against the positioning surface 116 and is positioned horizontally by the angled sides 104, 106. At this point, further upward movement of the edge portion is prevented by the positioning surface 116, and bending or crumpling of the carton near the edge portion is prevented by the restraining surfaces 118, 120. Accordingly, as an overstroke of the lifting bar 50 occurs, the carton will remain stopped in its predetermined position, and the spring-mounting of the suction cup assembly 52 will compress to compensate for the overstroke and to ensure that the carton remains in its predetermined position. The overstroke and compensation through the resilient mounting of the suction cups ensures that the edge portion of the carton rests against the entire surface of the positioning surface 116, thereby providing a repeatable positioning of the carton at the next station as will be described below. Accordingly, the object of reliably placing the carton at a predetermined position wherein the upper edge portion of the carton is located a predetermined distance X from a central axis of the cylindrical punch 150, wherein the distance X is the distance between the positioning surface 116 and the central axis of the punch 150, is accomplished. In the predetermined position, the central axis of the punch 150 is located centrally between sides of the carton which are perpendicular to the side in which the hole is to be punched since the angled sides 104, 106 are spaced apart at their upper ends by a distance equal to an inner width of a carton.

Once the edge portion of the carton is positioned, the piston of the piston-and-cylinder arrangement 130 is pushed rightward in FIG. 5 to move the rod 136 rightward, and to pivot the lever 138 clockwise about the pin 142. The second rod 144 and the punch base 146 thus move leftward in FIG. 5 toward the inner wall of the carton. Since the pin 156 and the ring 166 are spring-biased into positions which are more leftward in FIG. 5 than the leftmost end of the cylindrical punch 150, the pin 156 and the ring 166 contact the inner wall of the carton first to hold the carton against the die ring 174 and thus prevent tearing or deformation.

As the punch base 146 continues to move leftward in FIG. 5, the springs 160 and 168 compress and the cylindrical punch moves leftward to contact the inner wall of the carton. As is shown in FIG. 5, a punching end 176 of the punch 150 is scalloped such that upper and lower portions of the end 176 extend most leftwardly in FIG. 5 and thus form leading knife edges which contact the inner wall of the carton first. Thereafter, the punching end 176 of the punch 150 acts to shear through the carton wall to form a circular hole therethrough. The shearing action of the punch 150 is accomplished due in part to a close uniformity of an outer diameter of the punch 150 and an inner diameter of the die ring 174, which diameters are different by only a very small amount.

Since the passageway 126 through the positioning block 102 is located opposite the punch 150 and is connected to a source of suction (not shown), the piece of the carton wall which is punched out is immediately sucked through the passageway 126 and away from the station 20. To aid in achieving this result, a small blast of pressurized air is forced through the passage 162, the passage 172, and the passageway 158 to blast a right side, in FIG. 5, of the punched-out piece and thus further force the punched-out piece into the passageway 126.

The piston of the piston-and-cylinder arrangement 130 is then urged leftwardly in FIG. 5 by the pressure source (not shown), to pull the punch base 146, the punch 150, the pin 156, and the ring 166 back rightwardly away from the carton wall. The suction cup assembly 152 then pulls the carton downwardly in FIG. 5 away from the positioning block 102 as discussed above, and the carton is ready to move to the next station, i.e., the bonding agent applying station 22.

The Bonding Agent Applying Assembly

Figure 6:
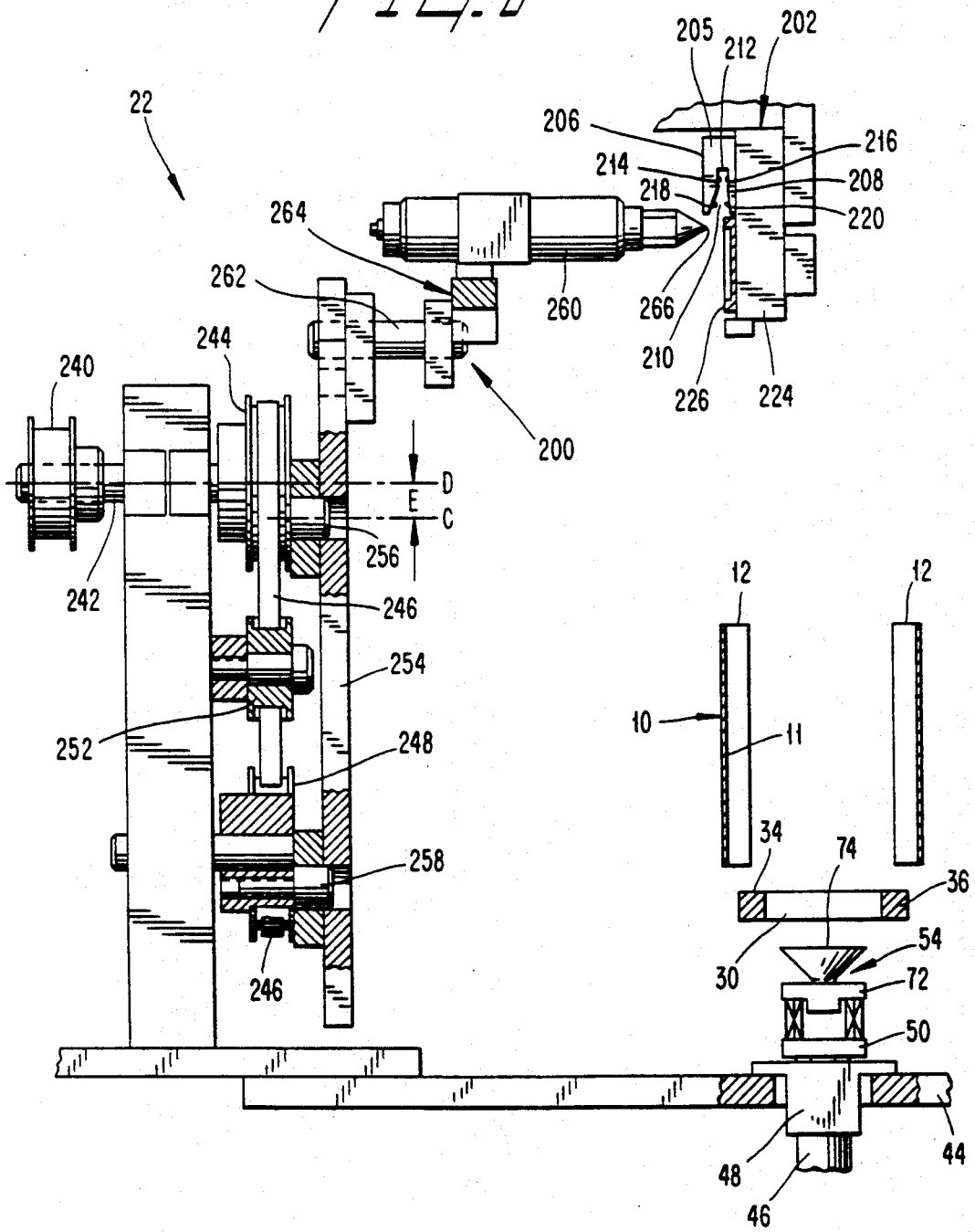
FIG. 6 is a partial cross-sectional side view of a bonding agent applying apparatus of the present invention.
Figure 7:
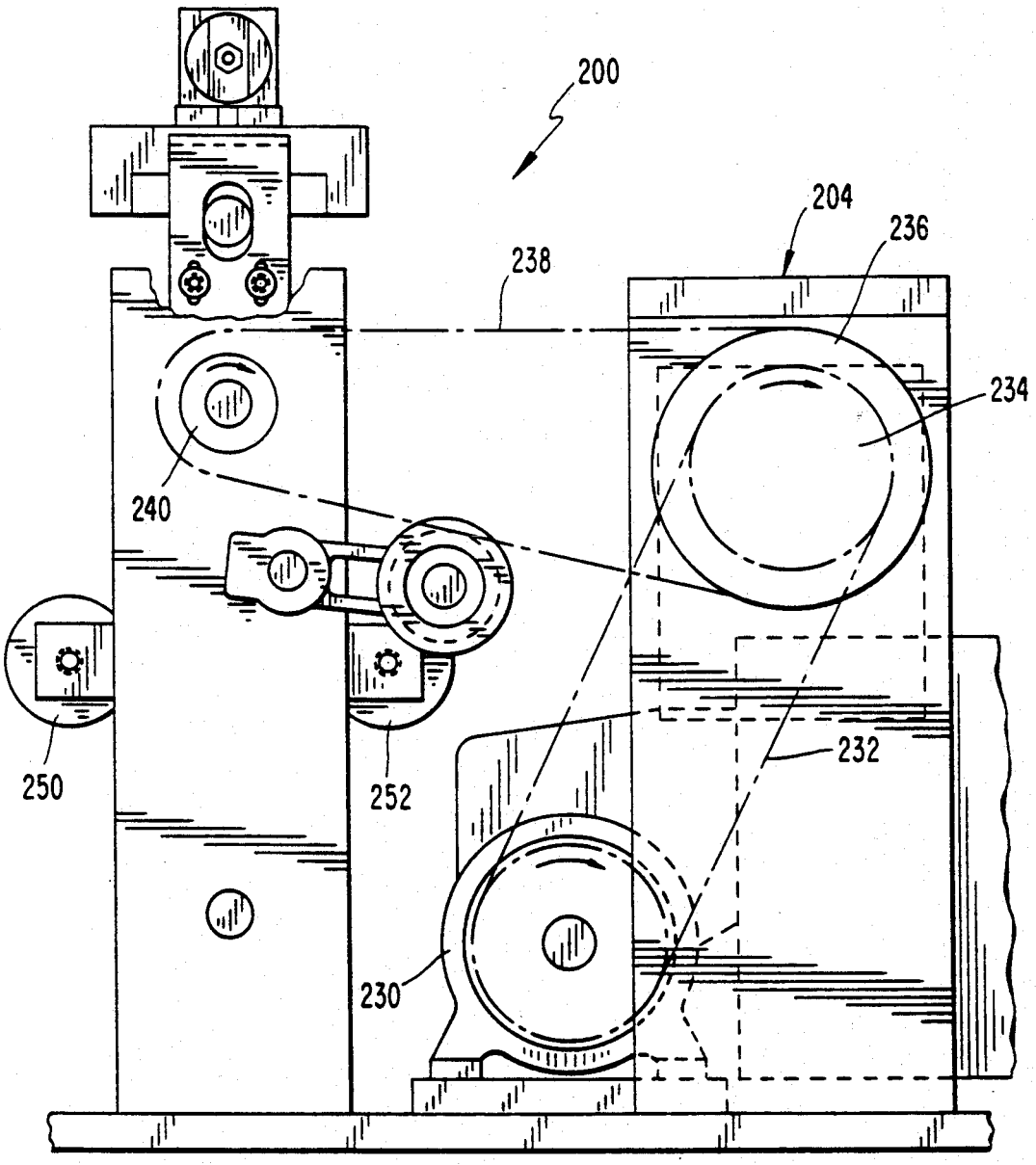
FIG. 7 is a partial front view of the bonding agent applying apparatus of FIG. 6.

FIG. 6 is a view of a portion of the station 22 similar to the view of the station 20 shown in FIG. 5. FIG. 7 is a front view, i.e., looking in the same direction as in FIG. 2, of a driving mechanism 204 of the bonding agent applying assembly 200. The station 22 includes the bonding agent applying assembly 200, which includes the second positioning block 202 and the driving mechanism 204. The conveyor 10, the rails 34, 36, and the suction cup assembly 54 extend into the station 22.

The positioning block 202 is constructed similarly to the positioning block 102 but is reversed, and includes a guiding and positioning piece 205 having two extensions 206, 208, a central slot 210, a positioning surface 212, two restraining surfaces 14, 216, and two guide surfaces 218, 220. The positioning block also includes two angled positioning sides 222, 224 (shown in FIG. 2) to help horizontally position a carton on the positioning block 202, and a cylindrical backing base 226 extending below the piece 205 toward rest of the bonding agent applying assembly 200.

As is shown in FIG. 7, the driving mechanism 204 includes a motor 230 which drives a toothed timing belt 232 and a timing belt pulley 234 constantly. The pulley 234 is connected to a timing belt pulley 236 which is coaxial therewith by a clutch (not shown), such that the pulley 236 can be selectively driven by the pulley 234. The pulley 236 drives a toothed timing belt 238 and thus a timing belt pulley 240 which is shown in both FIGS. 6 and 7. The gear ratio between the pulley 236 and the pulley 240 is 2 to 1, such that the pulley 240 rotates twice every time the pulley 236 rotates once.

As is seen in FIG. 6, the pulley 240 is connected by a shaft 242 to a timing belt pulley 244, and the pulley 244 drives a toothed timing belt 246 to drive a timing belt pulley 248. Tensioning pulleys 250, 252 tension either side of the belt 246 between the pulleys 244, 248, and the pulleys 244, 248 have a 1 to 1 gear ratio such that they turn at the same speed.

An elongated driving plate 254 is pivotally fixed to the pulleys 244, 248 by a pair of cam roll bearings 256, 258 which are fixed to the pulleys 244, 248 in eccentric positions. As shown in FIG. 6, the central axis C of the bearing 256 is spaced from the central axis D of the pulley 244 by a distance E, and the bearing 258 is similarly fixed to the pulley 248. The distance E is one-half of the diameter of the bonding agent circle which is to be placed on a carton around a hole therein, and is thus slightly less than one-half of the outside diameter of the backing base 226. The entire driving plate 254 thus rotates in a circle having a diameter of 2E when the pulley 240 rotates. A gun 260 is fixed to the driving plate 254 by a pin 262 and a bracket 264, and thus rotates with the driving plate 254 in a circle of diameter 2E when the pulley 240 rotates. The gun 260 is connected to a source of bonding agent (not shown) which is at high pressure, for example 5000 psi. The bonding agent may be an adhesive such as glue, or a chemical for an operation such as chemical etching.

In operation, when the conveyor 10 stops and thereby positions a carton within the station 22, the carton 5 is lifted by the suction cup assembly 54 and positioned against the positioning surface 212 in the same manner as described in the station 20. The inner wall 11 of the conveyor 10 is substantially coplanar with the holding surface 214 so that a wall of the carton is roughly in the correct transverse position when the operation is begun. The hole which is punched in the carton wall is automatically centered around a central applying axis of the gun 260, i.e., the axis about which the gun 260 rotates, since the distance between the central applying axis and the positioning surface 212 is equal to the distance X between the punching axis of the punch 150 and the positioning surface 116 in the station 20, and since the applying axis is located centrally between sides of the carton which are perpendicular to the side in which the hole is punched since the angled sides 222, 224 are spaced apart at upper ends thereof by a distance equal to an inner width of a carton.

The clutch (not shown) between the pulley 234 and the pulley 236 is then automatically engaged as long as an arm switch 290, which is shown in FIG. 2, detects the presence of a carton in the station 22. The pulley 236 is rotated through one revolution before the clutch is disengaged. The pulley 236 thus rotates through 360 degrees, and the pulley 240, the pulleys 244 and 248, the driving plate 254, and the gun 260 thus all rotate through 720 degrees due to the 2 to 1 gear ratio between the pulleys 236 and 240.

During a portion of the 720 degrees of rotation, bonding agent from the source of bonding agent (not shown) is forced through a tip 266 of the gun 260 for a period of time such that bonding agent is emitted by the tip over about 360–400 degrees of its rotation. This ensures that a complete, relatively uniform circle of bonding agent will be formed on the carton around the hole punched in the carton at station 20. The actual start of bonding agent emission is delayed for a set period of time after start of movement of the gun 260 so that the gun 260 will be moving at all times when it is applying the bonding agent to achieve better gluing control, since the gun 260 will neither accelerate nor decelerate during application of the bonding agent.

Once the emission of bonding agent by the gun 260 and the movement of the gun 260 have ceased, the carton is then lowered back onto the rails 34, 36 in the same manner described in station 20. The carton is then moved downstream by the conveyor 10 to the spout attaching station 24.

It is to be understood that the bonding agent applying assembly 200 is the preferred embodiment of a bonding site preparing means of the present invention, wherein a bonding site around a hole in a carton is prepared by placing a circle of bonding agent at the bonding site. However, other bonding site preparing means could be advantageously substituted for the apparatus 200, such as to prepare a bonding site which includes thermal or ultrasonic bonding.

The Spout Attaching Assembly

Figure 8:
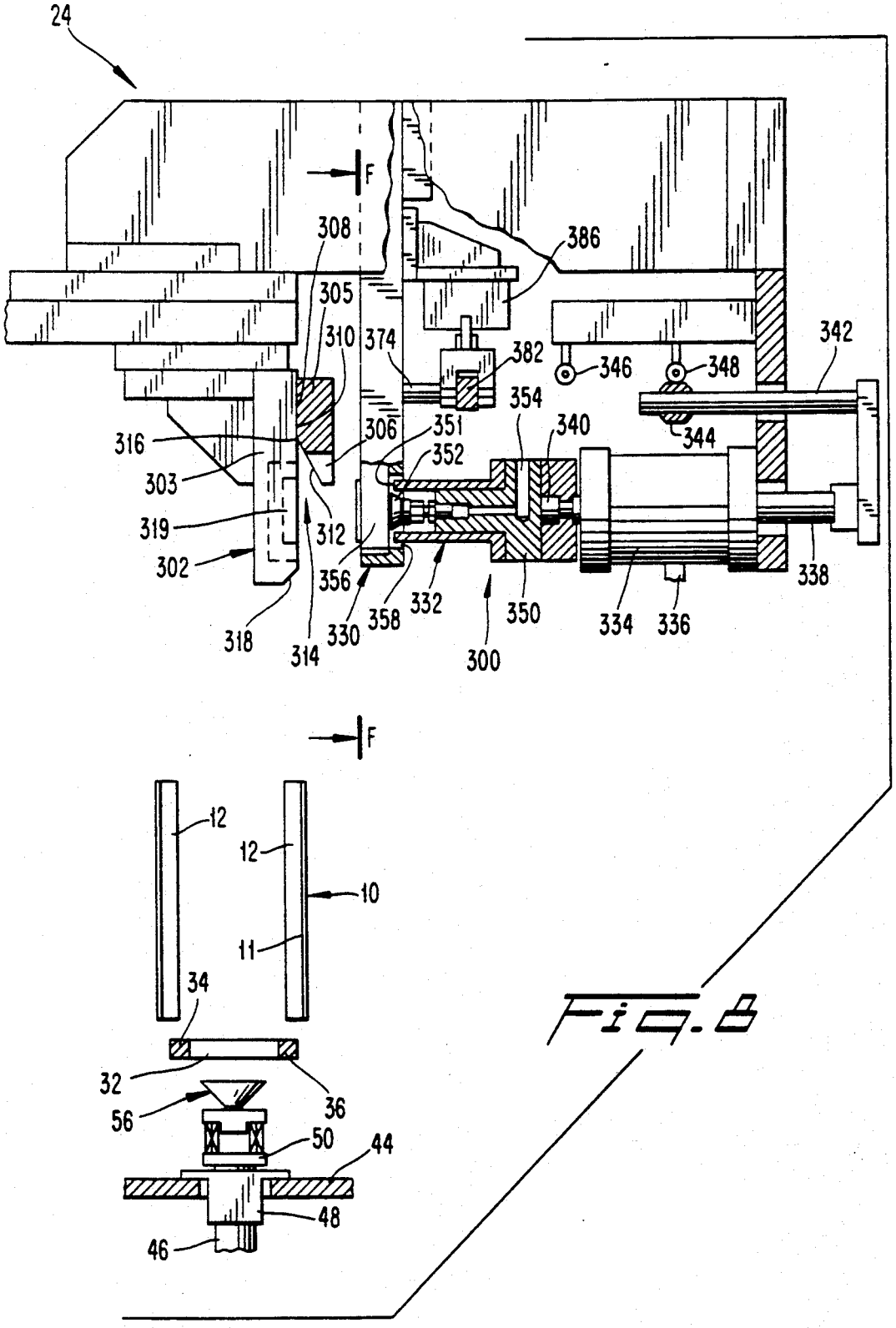
FIG. 8 is a partial cross-sectional side view of a spout attaching apparatus of the present invention.

FIG. 8 is a partially sectional side view of the station 24, taken from the left side of the station 24 in FIG. 2 looking in the direction B. FIG. 8 thus looks in the direction opposite the direction FIGS. 5 and 6 look. The station 24 includes the spout attaching assembly 300, which includes the third positioning block 302 and the vibratory spout feeder 304 (FIG. 2). The conveyor 10, the rails 34, 36, and the suction cup assembly 56 all extend into the station 24.

The positioning block 302 is similar to the positioning blocks 102, 202, but a portion 303 of the positioning block 302 helps a guiding and positioning piece 305 of the positioning block 302 guide and position cartons on the positioning block 302. Specifically, the piece 305 includes only one extension 306 having a positioning surface 308, a restraining surface 310, and a guiding surface 312 thereon. The portion 303 of the positioning block 302 forms a central slot 314 with the extension 306, and also forms a restraining surface 316 for cooperation with the restraining surface 310. A guiding surface 318 is also provided on a lower end of the portion 303, and a recess 319 is provided in the portion 303 to partially receive a portion of an attached spout, as will be described herein below. The portion 303 of the positioning block 302 also includes two angled positioning sides 320, 322, as shown in FIG. 2, which help to horizontally position a carton onto the positioning block 302.

The spout attaching assembly 300 also includes a spout supplying assembly 330, which will be described in more detail hereinbelow with reference to FIG. 9, and a spout attaching assembly 332. The spout attaching assembly 332 includes a piston-and-cylinder arrangement 334 which is connected (as at 336) to a source of pressure (not shown). A piston of the piston-and-cylinder arrangement 334 is rigidly connected to both a rod 338 which extends rightwardly in FIG. 8 from the arrangement 334, and a rod 340 which extends leftwardly in FIG. 8 from the arrangement 334. The rod 338 is connected rigidly to a rod 342 having a ring 344 thereon, and two limit switches 346, 348 are located within a translational path in which the ring 344 moves as the piston of the piston-and-cylinder arrangement 334 moves, as will be explained further hereinbelow.

The rod 340 is fixed at one end thereof to a spout attaching base 350 which extends toward the positioning block 302. The attaching base 350 is rigidly fixed to an attaching cup 352, and includes a suction/pressure passage 354 therein which is connected to a source of suction/pressure (not shown) via a T-valve (not shown), and which communicates with an interior of the cup 352. The spout supplying apparatus 330, as shown in FIG. 8, includes an elongate, vertical supply passage 356 and an opening 358 to allow the cup 352 to move horizontally into and through the supply passage 356.

Figure 9:
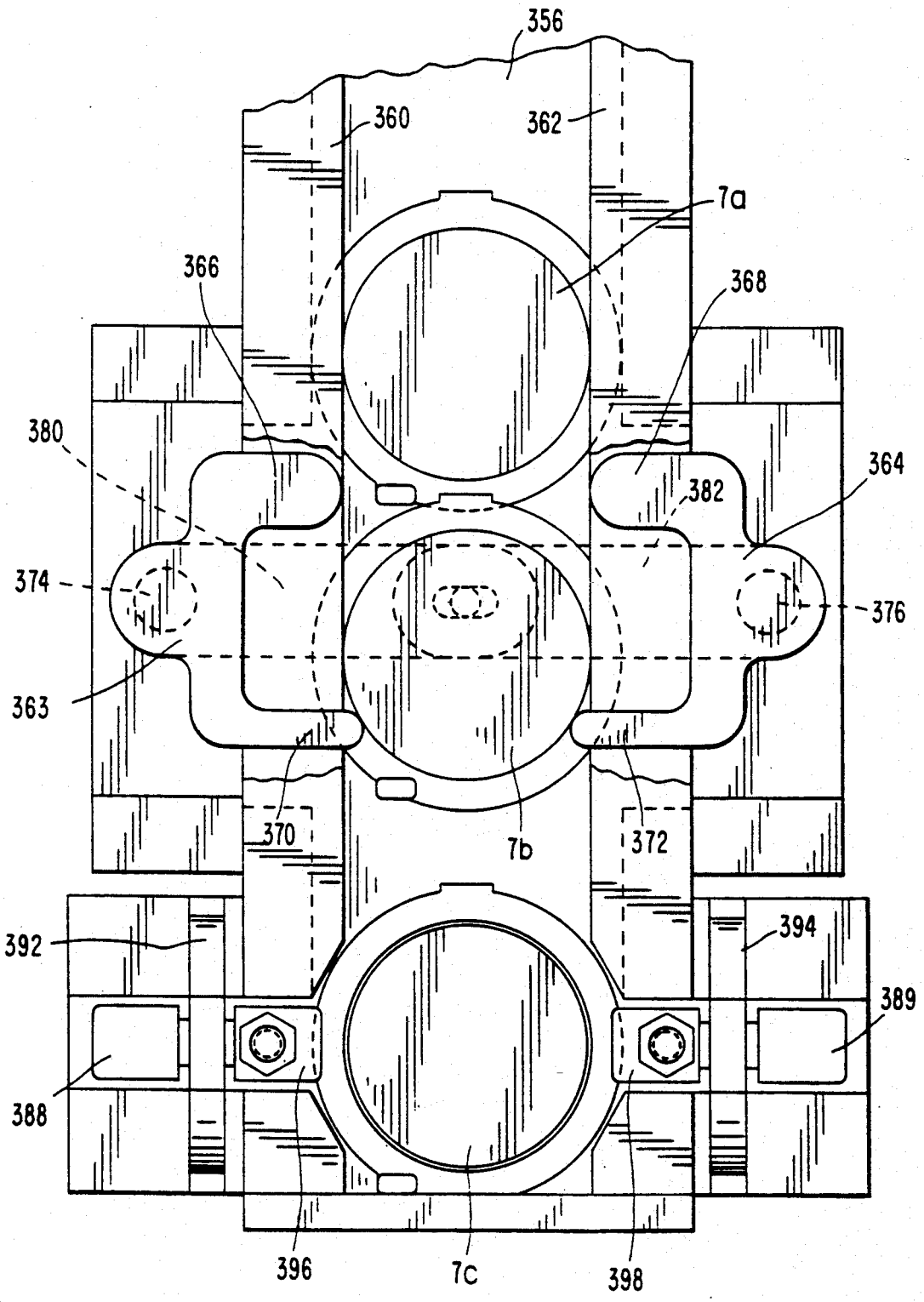
FIG. 9 is a view along line F—F of FIG. 8.

As shown in FIG. 9, which is a view along line F—F in FIG. 8, the supply passage 356 extends upwardly in the Figures, and, as shown schematically in FIG. 2, the supply passage 356 extends up to the vibratory spout feeder 304 (not drawn to scale) where a supply of correctly-oriented spouts are fed one-by-one into the supply passage 356. The spouts fall down the supply passage 356 with their inner ends extending outwardly in FIG. 9, and two rails 360, 362 hold the spouts in the passage 356.

At a position above the cup 352, two levers 363, 364 having upper arms 366, 368 and lower arms 370, 372 are located. The levers 363, 364 act to regulate the flow of spouts in the passage 356 as will be explained hereinbelow, and they are rigidly mounted to pins 374, 376 which extend pivotally through a base 378 of the spout supplying apparatus 330. The pins 374, 376 are rigidly attached to two arms 380, 382 (shown in dotted lines in FIG. 9), which are in turn pivotally attached to a pin 384 (also shown in dotted lines in FIG. 9). The pin 38 is rigidly attached to a piston of a piston and cylinder arrangement 386, which is shown in FIG. 8.

At a position adjacent the cup 352, two fingers 388, 389 extend into the passage 356. The fingers 388, 389 are pivotable about pins 392, 394 and are spring-biased to hold the portions 396, 398 of the fingers 388, 389 down against a spout *7a* in FIG. 9. The opening 358 is located in FIG. 9 behind the spout *7a* coaxial with the spout *7a*, and has a smaller diameter than the spout *7a*.

In operation, a carton is lifted to the positioning block 302 and positioned on the positioning surface 308 in the same manner as occurred in the stations 20 and 22. The carton is roughly positioned in a correct transverse direction at the start of the operation by the inside wall 11 of the conveyor 10, which is coplanar with the restraining surface 310. Once an upper edge portion of the carton is positioned against the positioning surface 308, the hole which has been punched in the carton in the station 20 is automatically centered on a central attaching axis of the attaching cup 352. This automatic centering occurs because a central longitudinal axis of the attaching cup 352, i.e., the central attaching axis, is located a distance from the positioning surface 308 which is equal to the distance X between the punching axis of the punch 150 and the positioning surface 116 in the station 20, and since the central attaching axis is centered between sides of the carton which are perpendicular to the side in which the hole is punched since the angled sides 320, 322 are spaced apart at upper ends thereof by a distance equal to an inner width of a carton.

As long as an arm switch 390 detects a carton in the station 24, the piston of the piston-and-cylinder arrangement 334 is then moved leftward in FIG. 9 by the pressure source (not shown). This movement moves the ring 334 out of contact with the limit switch 348, which automatically causes the source of pressure (not shown) to move the piston of the piston-and-cylinder arrangement 386 upwardly in FIGS. 8 and 9 to move the pin 384 upwardly. This upward movement accordingly causes the arm 380, the pin 374, and the lever 363 to rotate counterclockwise, and the arm 382, the pin 376, and the lever 364 to rotate clockwise. These rotations are continued until the upper arms 366, 388 of the levers 362, 364 have moved sufficiently out of the supply passage 356 to allow a spout 76 to fall downwardly in FIG. 9 between the levers 362, 364, as shown in FIG. 9. The lower arms 370, 372 have by this time rotated significantly into the passage 356, and the spout 76 falls until it contacts the lower arms 370, 372.

The attaching cup 352 is also moved leftward through the opening 358 and into contact with the outer end of the spout *7a*, which is held by the portions 396, 398 of the fingers 388, 389. The suction/pressure source (not shown) to which the cup 352 is attached through the passage 354 provides a negative pressure or suction to the cup 352 as long as the ring 344 is out of contact with the switch 346, such that the cup 352 holds the spout *7a* by suction against an outer ring-like end 351 of the spout attaching base 350, as soon as the cup 352 contacts the spout.

The cup 352 continues to move leftward in FIG. 8, and it thereby forces the spout *7a* to push the portions 396, 398 of the fingers 388, 389 outwardly against their spring-bias until the spout *7a* snaps clear of the fingers 388, 389. The cup 352 then forces the spout *7a* into a position extending about and through the hole in the carton, such that the spout *7a* is adhered to the carton by the bonding agent around the hole in the carton, and such that an end of the spout *7a* extends slightly into the recess 319. At this point, the ring 344 around the rod 342, which has moved rigidly with the cup 352, contacts the limit switch 346 and the T-valve (not shown) is switched to send a small blast of pressurized air from the suction/pressure source (not shown) down the passage 354 to the cup 352 to release the cup's hold on the spout *7a* and to further urge the spout *7a* against the carton.

The cup 352 is then moved rightward by the arrangement 334 until the cup 352 is in the position shown in FIG. 8. The ring 344 thereby contacts the limit switch 348. The contact of the ring 344 against the limit switch 348 causes a pressure source (not shown) to act to move the piston of the piston-and-cylinder arrangement 386 downwardly in FIGS. 8 and 9, which thereby also moves the pin 384 downwardly. The arm 380, the pin 374, and the lever 363 thereby rotate clockwise, and the arm 382, the pin 376, and the lever 364 rotate counterclockwise until the lower arms 370, 372 move out of the passage 356 far enough to allow the spout *7b* drop to the position where the spout *7a* is shown in FIG. before the next carton arrives. While this occurs, the upper arms 366, 368 remain in the passage 356 to block a spout *7c* from falling further down the passage 356 than the position in which it is shown in FIG. 9.

At the same time, the carton is lowered from the positioning block 302 in the same manner as occurred in the stations 20, 22, with the end of the spout moving easily out of the recess 319 due to a bevel on the outer surface of the end of the spout. The carton is then moved by the conveyor 10 onto a filling station (not shown).

Figure 10:
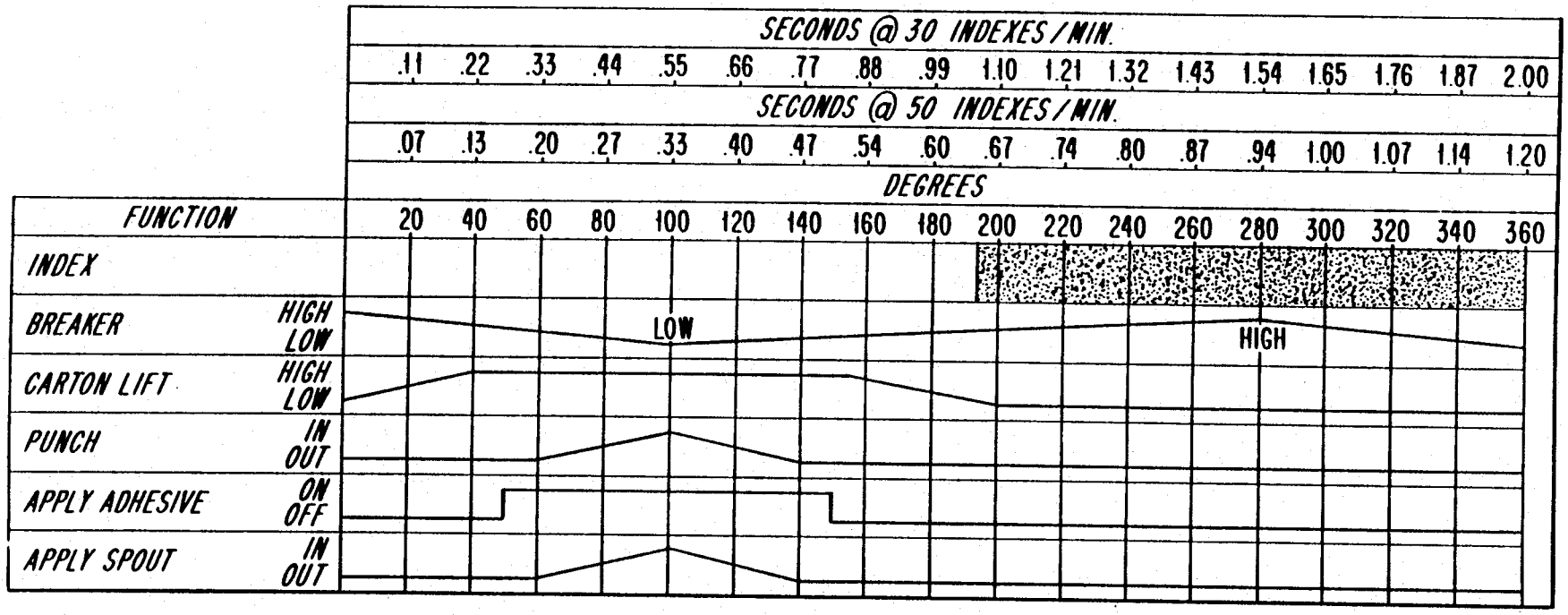
FIG. 10 is a timing chart for the operation of the apparatus of the present invention.

FIG. 10 is a chart of the timing of the various pieces of apparatus of the present invention. As shown, the carton forming and filling machine in which the present invention is integrated is indexed such that the conveyor 10 remains stationary for the first 195 degrees of a 360 degree indexing period, and then moves the cartons 5 to a next station during the remaining 165 degrees of the indexing period. Thus, a time of approximately 0.65 seconds is available, at 50 indexes per minute, in which each of the stations 20, 22, and 24 must perform its function. Less time is available as the speed of the machine is increased.

As shown, the lifting device 40 operates to position cartons 5 against respective positioning surfaces of the positioning blocks 102, 202, 302 in about the first 0.13 seconds, and the lifting device 40 takes about the last 0.13 seconds of the available time to lower the cartons 5 back to the rails 34, 36. The hole punch 100, the bonding agent applying assembly 200, and the spout attaching assembly 300 thus each have about 0.4 seconds in which to perform their respective functions, as shown. As discussed above, the ability of the apparatus of the present invention to repeatedly position paperboard cartons in precise predetermined positions in such short periods of time is an important object of the present invention, since the present invention can be integrated into a high-speed packaging machine without slowing down the operation of the machine.

Figure 11:
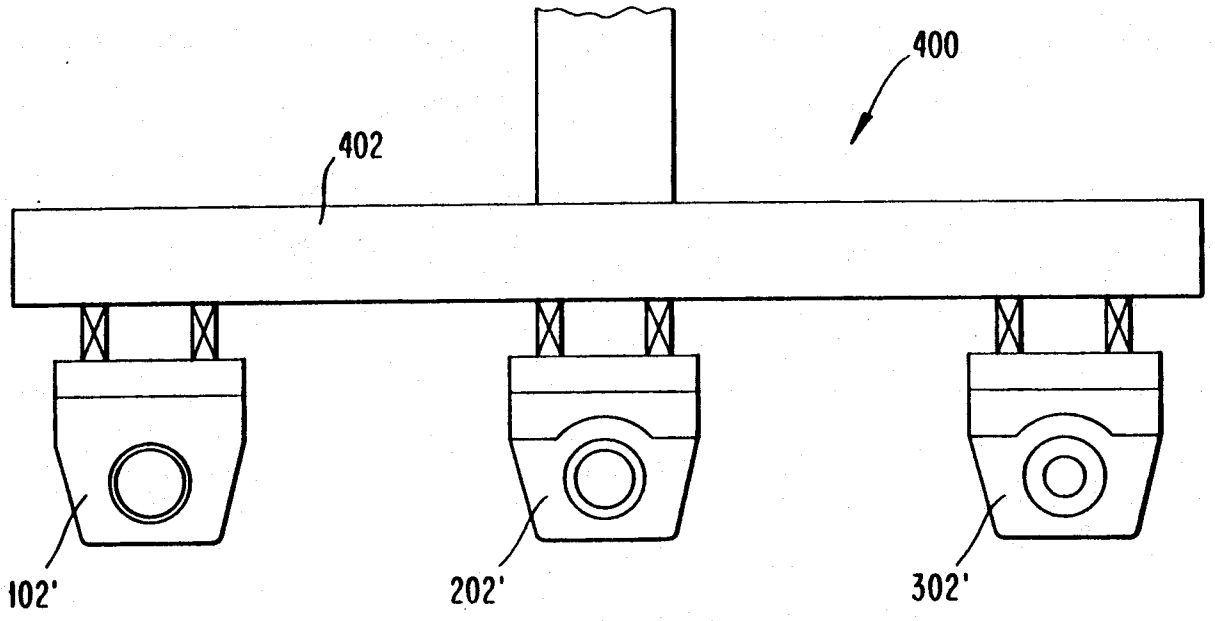
FIG. 11 is a partial front view of a second embodiment of the present invention.

FIG. 11 is a front view of a second embodiment of the present invention. In the second embodiment, the lifting device of the first embodiment is removed, and is replaced by a lowering device 400 shown generally in FIG. 11. The lowering device 400 includes a large plate or bar 402 to which are spring mounted three positioning blocks 102', 202', and 302', as well as a hole punch 100', a bonding agent applying assembly 200', and a spout attaching assembly 300' (not shown). The bar 402 lowers the positioning blocks and the assemblies down to three cartons at a time, and the spring mountings act to compensate for a designed overstroke of the bar 402 to ensure that positioning surfaces of the positioning blocks 102', 202', and 302' are properly positioned on edge portions of the three cartons.

The principles, preferred embodiments, and mode of operation of the present invention have been described in the foregoing specification. However, the invention which is intended to be protected is not to be construed as limited to the particular embodiment disclosed. The embodiments are to be regarded as illustrative rather than restrictive. Variations and changes may be made by others without departing from the spirit of the present invention. Accordingly, it is expressly intended that all such equivalents, variations and changes which fall within the spirit and scope of the present invention as defined in the claims be embraced thereby.

We claim:

1. A method of attaching a spout to a planar portion of a container of relatively stiff material, comprising the steps of:

moving said container successively to at least three stations of a conveyor line;

positioning an edge portion perpendicular to a direction of travel and in the plane of said planar portion at a first predetermined position relative to a hole punching at a first station;

punching a hole through said planar portion at said first station;

repositioning said edge portion at a second predetermined position relative to a bonding site prepared at a second station;

preparing a bonding site on said planar portion around said hole at said second station;

repositioning said edge portion at a third predetermined position relative to a spout applicator at a third station; and attaching a spout to said planar portion about said hole at said third station.

2. A method as claimed in claim 1, wherein each of said positioning steps includes relative vertical movement of said container and a positioning surface, said relative vertical movement guiding said edge portion into contact with said positioning surface.

3. A method as claimed in claim 1, wherein each of said positioning steps include urging a bottom of said container upwardly with resilient means, and moving said article upwardly until said edge portion positions against a positioning surface, said resilient means ensuring that said portion positions against said positioning surface.

4. A method as claimed in claim 1, wherein each of said positioning steps include lowering a positioning surface and said hole punch, said bonding site preparer, and said spout applicator, respectively, and guiding said positioning surface into contact with said edge portion.

5. A method as claimed in claim 1, wherein each of said positioning steps includes lowering a positioning surface and said hole punch, said bonding site preparer, or said spout applicator, respectively, with resilient lowering means, and moving said positioning surface downwardly until it positions against said edge portion, said resilient lowering means ensuring that said positioning surface positions against said edge portion.

6. A method as claimed in claim 1, wherein each of said positioning steps includes guiding said edge portion into position against a substantially horizontal positioning surface with a positioning block which includes said positioning surface, two substantially vertical, spaced restraining surfaces which contact and restrain opposite sides of said planar portion near said edge portion, and at least one guide surface which is angled from vertical to guide said edge portion between said restraining surfaces.

7. A method as claimed in claim 1, wherein each of said urging means is a suction cup spring-mounted on a movable structure.

8. A method as claimed in claim 7, wherein said suction cups are spring-mounted individually to an elongated lifting bar.

9. A method as claimed in claim 1, further including the steps of:

detecting the presence of said container prior to said gluing step; and detecting the presence of said container again prior to said spout attaching step.

10. A method as claimed in claim 1, wherein bonding site preparing step includes applying glue around said hole in said planar portion.

11. A method as claimed in claim 1, wherein said positioning steps each include horizontally positioning said container.

12. A method as claimed in claim 1, wherein said punching step includes punching said hole from an inside toward an outside of said container.

13. A method as claimed in claim 1, wherein said attaching step includes holding said spout against a cup by suction, and moving said cup to move said spout into said hole.

14. A method as claimed in claim 1, further including the step of:

forming a bottom on said container at a fourth station prior to said first positioning step, said first and fourth stations being separate stations.

15. An apparatus for attaching a spout to a planar portion of a container of relative stiff material, comprising:

a hole punch;

a first positioning means having a first positioning surface thereon located in a first predetermined position relative to said hole punch, for positioning the container relative to said hole punch;

a bonding site preparer;

a second positioning means having a second positioning surface thereon located in a second predetermined position relative to said bonding site preparer, for positioning the container relative to said bonding site preparer;

a spout applicator;

a third positioning means having a third positioning surface thereon located in a third predetermined position relative to said spout applicator, for positioning the container relative to said spout applicator; and each of said first, second and third positioning surface being located parallel to a direction of travel of the container and being in the plane of the planar portion.

16. An apparatus as claimed in claim 15, wherein said first, second, and third positioning surfaces are each substantially horizontal for positioning an edge portion of the planar portion, and wherein said first, second, and third positioning means each include two substantially vertical, spaced restraining surfaces for restraining opposite sides of the planar portion near the edge portion, and at least one guide surface which is angled from vertical to guide the edge portion between said restraining surfaces.

17. An apparatus as claimed in claim 15, further including:

a first lifting device located beneath said first positioning means to lift the container to said first positioning means;

a second lifting device located beneath said second positioning means to lift the container to said second positioning means; and a third lifting device located beneath said third positioning means to lift the container to said third positioning means.

18. An apparatus as claimed in claim 17, wherein said first, second, and third lifting devices are suction cups connected to a source of suction and spring-mounted to an elongated lifting bar.

19. An apparatus as claimed in claim 15, wherein said hole punch includes a longitudinal central axis which is spaced a first distance from said first positioning surface, wherein said bonding site preparer is a glue applicator which rotates about an axis which is spaced a second distance from said second positioning surface, wherein said spout applicator has a longitudinal central axis which is spaced a third distance from said third positioning surface, and wherein said first, second, and third distances are all equal.

20. An apparatus as claimed in claim 15, further including:

a first arm switch located beneath said second positioning means;

first enabling means for enabling said bonding site preparer when said first arm switch is actuated;

a second arm switch located beneath said third positioning means; and second enabling means for enabling said spout applicator when said second arm switch is actuated.

21. An apparatus as claimed in claim 15, wherein each of said first, second, and third positioning means includes horizontal positioning means.

22. An apparatus as claimed in claim 21, wherein each of said horizontal positioning means include two positioning surfaces angled from vertical.

23. An apparatus as claimed in claim 15, wherein said first positioning means is for positioning the container around said hole punch.

24. An apparatus as claimed in claim 15, wherein said spout applicator includes a cup for moving the spout into the hole in the container, and suction means for holding the spout to said cup during said movement.

25. An apparatus for attaching a spout to a planar portion of a container, comprising:

punching means for punching a hole, said punching means punching along a central punching axis;

first positioning means for positioning an edge portion of the planar portion, said first positioning means being spaced from said punching axis by a predetermined distance;

bonding agent applying means for applying bonding agent in a circle about a central applying axis;

second positioning means for positioning the edge portion of the planar portion, said second positioning means being spaced from said applying axis by said predetermined distance;

spout attaching means for attaching a spout, said spout attaching means having a central attaching axis;

third positioning means for positioning the edge portion of the planar portion, said third positioning means being spaced from said attaching axis by said predetermined distance; and each of said first, second and third positioning surface being located parallel to a direction of travel of the container and being in the plane of the planar portion.

26. An apparatus as claimed in claim 25, further including:

first restraining means located adjacent said first positioning means;

second restraining means located adjacent said second positioning means; and third restraining means located adjacent said third positioning means, said first, second, and third restraining means for restraining the planar portion near the edge portion and preventing the planar portion from bending.

27. An apparatus as claimed in claim 26, further including:

first guiding means for guiding the edge into said first restraining means;

second guiding means for guiding the edge into said second restraining means; and third guiding means for guiding the edge into said third restraining means.

28. An apparatus as claimed in claim 25, further including:

first lifting means for lifting the container into position against said first positioning means;

second lifting means for lifting the container into position against said second positioning means; and third lifting means for lifting the container into position against said third positioning means.

29. An apparatus as claimed in claim 28, wherein said lifting means each include compensating means for compensating for an overstroke of said lifting means.

30. An apparatus as claimed in claim 25, further including:

first detecting means for detecting the presence of the container beneath said second positioning means;

first enabling means for enabling said bonding agent applying means in response to detection of the container by said first detecting means;

second detecting means for detecting the presence of the container beneath said third positioning means; and second enabling means for enabling said spout attaching means in response to detection of the container by said second detecting means.

31. An apparatus for attaching a spout to a gable top of a paperboard carton, comprising:

a hole punch mounted for translation along a punching axis;

a first positioning means including a substantially horizontal first positioning surface spaced from said punching axis by a predetermined distance;

a glue applicator mounted for rotation about a central gluing axis;

a second positioning means including a substantially horizontal second positioning surface spaced from said gluing axis by said predetermined distance;

a spout applicator mounted for translation along a spout applying axis;

a third positioning means including a substantially horizontal third positioning surface spaced from said spout applying axis by said predetermined axis; and an elongated lifting bar extending beneath said first, second, and third positioning means, said lifting bar including three suction cups connected to a source of suction and spring-mounted to said lifting bar beneath said first, second, and third positioning means, respectively.

32. A method of attaching a spout to a planar portion of a container of relatively stiff material, comprising the steps of:

moving said planar portion in a direction of travel;

positioning an edge portion perpendicular to the direction of travel and in the plane of said planar portion at a first predetermined position relative to a hole punch at a first station;

punching a hole through said planar portion at said first station;

applying a bonding agent between said planar portion and said spout;

repositioning said edge portion at a second predetermined position relative to a spout applicator at a second station; and attaching a spout to said planar portion about said hole at said second station.

33. An apparatus for attaching a spout to a planar portion of a container of relatively stiff material, comprising:

a hole punch;

first positioning means having a first positioning surface thereon located in a first predetermined position relative to said hole punch, for positioning the container relative to said hole punch;

applying means for applying a bonding agent between the container and the spout;

a spout applicator;

second positioning means having a second positioning surface thereon located in a second predetermined position relative to said spout applicator, for positioning the container relative to said spout applicator; and each of said first and second positioning means having a surface located parallel to a direction of travel of the container and in the plane of the planar portion.

* * * * *